US010280907B2

(12) United States Patent
Ohta et al.

(10) Patent No.: US 10,280,907 B2
(45) Date of Patent: May 7, 2019

(54) BOOSTER PUMP

(71) Applicant: MITSUI ENGINEERING & SHIPBUILDING CO., LTD., Tokyo (JP)

(72) Inventors: Kazushige Ohta, Tamano (JP); Makoto Kounosu, Tokyo (JP)

(73) Assignee: MITSUI E&S MACHINERY CO., LTD., Tokyo (JP)

( * ) Notice: Subject to any disclaimer, the term of this patent is extended or adjusted under 35 U.S.C. 154(b) by 0 days.

(21) Appl. No.: 15/642,051

(22) Filed: Jul. 5, 2017

(65) Prior Publication Data

US 2018/0010588 A1 Jan. 11, 2018

(30) Foreign Application Priority Data

Jul. 5, 2016 (JP) ..... 2016-132981

(51) Int. Cl.
*F04B 15/08* (2006.01)
*F02M 37/00* (2006.01)
(Continued)

(52) U.S. Cl.
CPC ..... *F04B 15/08* (2013.01); *F02M 37/0052* (2013.01); *F04B 9/1053* (2013.01); *F04B 53/10* (2013.01); *F04B 2015/081* (2013.01)

(58) Field of Classification Search
CPC ..... F04B 15/08; F04B 2015/081; Y10T 137/7871
See application file for complete search history.

(56) References Cited

U.S. PATENT DOCUMENTS 4,501,251 A * 2/1985 Kelch ..... F02M 53/00 123/198 C
5,188,519 A 2/1993 Spulgis
(Continued)

FOREIGN PATENT DOCUMENTS

JP H05-18352 A 1/1993
JP 2002-521613 A 7/2002
(Continued)

*Primary Examiner* — Patrick Hamo
(74) *Attorney, Agent, or Firm* — Juan Carlos A. Marquez; Marquez IP Law Office, PLLC

(57) ABSTRACT

The present invention prevents a gas generated by evaporating a low-temperature liquid from remaining in an internal space of a booster pump and enhances efficiency of discharge and suction. A reciprocating booster pump 50 includes a cylinder 41, a piston 42, a suction check valve 65, and a discharge check valve 62. The cylinder 41 has a suction port 55 and a discharge port 56. The suction port 55 suctions a low-pressure, low-temperature liquid to an inside. The discharge port 56 boosts the low-temperature liquid and discharges the low-temperature liquid to an outside. The piston 42 reciprocates in an internal space 43 of the cylinder. The suction check valve 65 opens and closes a suction flow passage 64 between the internal space and the suction port. The discharge check valve 62 opens and closes a discharge flow passage 61 between the internal space and the discharge port. The suction check valve is configured such that if a relative pressure at the internal space establishing a pressure of the low-temperature liquid before being suctioned into the cylinder as a criterion is higher than a predetermined pressure, the suction check valve closes.

10 Claims, 3 Drawing Sheets

(51) Int. Cl.
*F04B 53/10* (2006.01)
*F04B 9/105* (2006.01)

(56) References Cited

U.S. PATENT DOCUMENTS

| | | | | |
|---|---|---|---|---|
| 6,231,310 | B1 * | 5/2001 | Tojo | F04B 35/045 417/417 |
| 6,374,852 | B1 * | 4/2002 | Olivas | F16K 17/30 137/493.9 |
| 6,439,863 | B1 | 8/2002 | McKay | |
| 7,377,286 | B2 * | 5/2008 | King, Jr. | E03B 7/12 137/1 |
| 8,881,757 | B2 * | 11/2014 | Melcher | B05B 12/14 137/240 |
| 2013/0037132 | A1 * | 2/2013 | Schmoll | F16K 17/30 137/498 |
| 2015/0369228 | A1 * | 12/2015 | Kounosu | F17C 13/04 123/27 GE |

FOREIGN PATENT DOCUMENTS

| | | | |
|---|---|---|---|
| JP | 2006-170146 | A | 6/2006 |
| JP | 2007-100645 | A | 4/2007 |
| JP | 2012-163018 | A | 8/2012 |
| JP | 5519857 | B1 | 6/2014 |

* cited by examiner

BOOSTER PUMP

FIELD OF THE INVENTION

The present invention relates to a reciprocating booster pump that boosts a low-temperature liquid such as a liquefied natural gas.

BACKGROUND

A conventional ship employs a two-stroke cycle, low-speed diesel engine that ensures outputs at a low speed and can be driven by being directly coupled to a propeller.

Recently, NOx, SOx, and a natural gas of less amount of emission have attracted the attention as a fuel for the low-speed diesel engine. An injection of a high-pressure natural gas as the fuel to a combustion chamber of the low-speed diesel engine and burning of the high-pressure natural gas obtains the output at high thermal efficiency.

To boost the liquefied natural gas, for example, a reciprocating booster pump that includes a cylinder and a piston reciprocating at an inside of the cylinder is used (for example, see Japanese Patent No. 5519857). The cylinder has suction ports to suction a low-temperature liquid such as a liquefied natural gas to the inside and a discharge port to boost the low-temperature liquid and discharge the low-temperature liquid to an outside. The booster pump includes a suction check valve to open and close a suction flow passage between an internal space of the cylinder and the suction ports, and a discharge check valve to open and close a discharge flow passage between the internal space and the discharge port. The suction check valve is adjusted to open when a pressure at the internal space of the cylinder becomes smaller than a pressure of the low-temperature liquid before the boost. The discharge check valve is adjusted to open when the pressure at the internal space of the cylinder becomes higher than the pressure of the low-temperature liquid after the boost.

CITATION LIST

Patent Literatures

[Patent Literature 1] JP 5519857 B1

SUMMARY OF INVENTION

Technical Problem

To boost a low-temperature liquid using a reciprocating booster pump, the booster pump has not yet cooled down to a temperature of the low-temperature liquid at a start of the booster pump. At this time, suctioning the low-temperature liquid into a cylinder of the booster pump evaporates the low-temperature liquid in the cylinder and turns the low-temperature liquid into a gas. When the gas is generated by evaporating the low-temperature liquid in the internal space of the cylinder, a discharge check valve does not open until the gas is compressed and a pressure at the internal space becomes higher than a pressure of the low-temperature liquid after the boost, which causes a problem of lowering the discharge efficiency of the gas. When the gas generated by evaporating the low-temperature liquid remains in the internal space of the cylinder, the pressure at the internal space of the cylinder is less likely to decrease. This is less likely to open the suction check valve, which also causes a problem of lowering the suction efficiency. Since the booster pump has an ordinary temperature especially at the start of the booster pump, supplying the liquid fuel to the internal space of the booster pump generates a large amount of gas generated by evaporating the liquid fuel in the internal space of the booster pump until the booster pump is cooled down to a temperature of the liquid fuel. Accordingly, the gas generated in the internal space of the booster pump needs to be efficiently discharged to an outside of the booster pump.

An object of the present invention is to provide a booster pump that can prevent a gas generated by evaporating a low-temperature liquid from remaining in an internal space of the booster pump and enhance efficiency of discharge and suction.

SUMMARY

A first aspect of the present invention is a reciprocating booster pump that includes a cylinder, a piston, a suction check valve, a discharge check valve, a first biasing member, and a second biasing member. The cylinder has a suction port and a discharge port. The suction port suctions a low-pressure, low-temperature liquid to an inside. The discharge port is for boosting and discharging the low-temperature liquid to an outside. The piston reciprocates in an internal space of the cylinder. The suction check valve opens and closes a suction flow passage between the internal space and the suction port. The discharge check valve opens and closes a discharge flow passage between the internal space and the discharge port. The first biasing member biases a valve element of the suction check valve in a direction away from a valve seat. The second biasing member biases the valve element in a direction of approaching the valve seat. The suction port is disposed to be communicated with an upper end portion of the internal space of the cylinder. The suction check valve is configured such that if a relative pressure at the internal space establishing a pressure of the low-temperature liquid before being suctioned into the cylinder as a criterion is higher than a predetermined pressure, the suction check valve closes.

The following configuration is preferable. A biasing force to the valve element by the first biasing member and a biasing force to the valve element by the second biasing member are adjusted to be balanced at a position where the valve element is away from the valve seat.

The following configuration is preferable. The suction check valve is configured such that if a force larger than a drag by a gas generated by evaporating the low-temperature liquid acts on the valve element of the suction check valve in a direction that the valve element approaches the valve seat of the suction check valve, the suction check valve closes.

Another aspect of the present invention is a method for boosting a low-temperature liquid that boosts a low-pressure, low-temperature liquid to produce a high pressure liquid. The method includes disposing, adjusting, and flowing. The disposing disposes a suction check valve, a first biasing member, and a second biasing member in a cylinder of a booster pump. The booster pump boosts the low-temperature liquid from a low-pressure liquid supply pipe that supplies the low-pressure, low-temperature liquid. The suction check valve is configured to suction the low-temperature liquid into an internal space of the cylinder. The suction check valve prevents the low-temperature liquid from flowing backward from the booster pump to the low-pressure liquid supply pipe. The first biasing member biases a valve element of the suction check valve in a direction away from a valve seat. The second biasing member biases the valve element in a direction of approaching the valve seat. The adjusting adjusts the suction check valve such that if a force larger than a drag by a gas generated by evaporating the low-temperature liquid acts on the valve element of the suction check valve in a direction that the valve element approaches the valve seat of the suction check valve, the suction check valve closes. The flowing flows the gas generated by evaporating the low-temperature liquid in the booster pump backward to the low-pressure liquid supply pipe through the suction check valve.

Advantageous Effects of Invention

The present invention can prevent a gas generated by evaporating a low-temperature liquid from remaining in an internal space of a booster pump and enhance efficiency of discharge and suction.

DETAILED DESCRIPTION

The following describes a fuel supply device according to an embodiment of the present invention with reference to the drawings.

Figure 1:
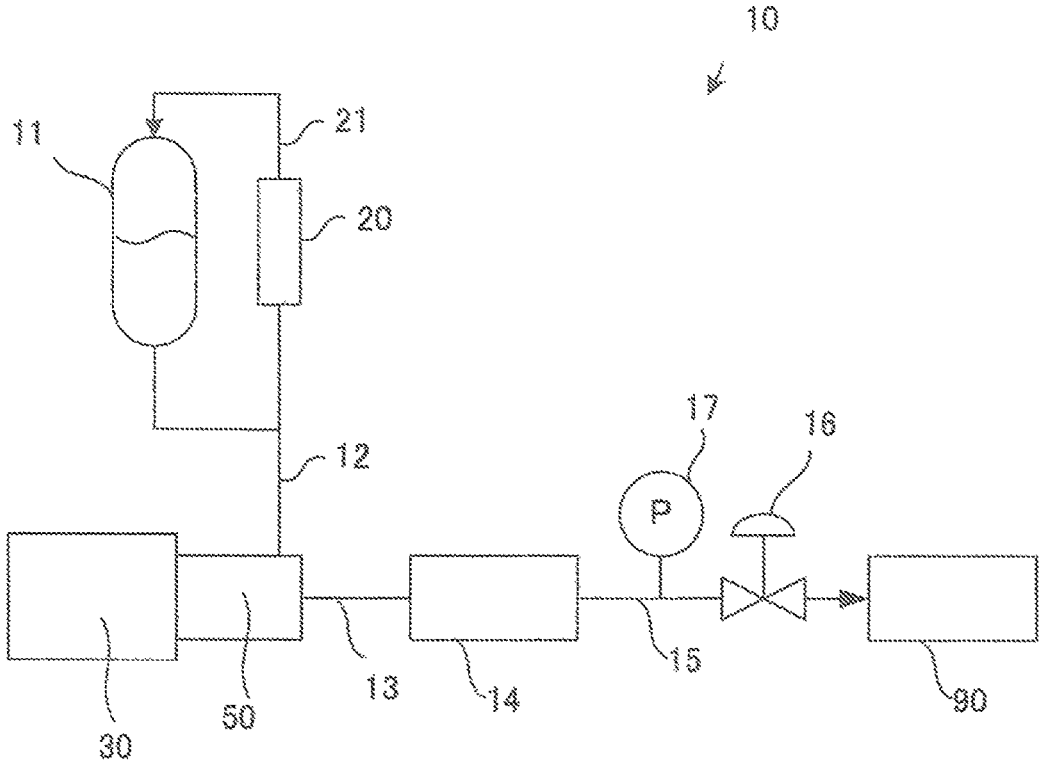
FIG. 1 is a schematic configuration diagram of a fuel supply device 10 according to a first embodiment.

FIG. 1 is a schematic configuration diagram of a fuel supply device 10 according to the embodiment. As illustrated in FIG. 1, the fuel supply device 10 of this embodiment is a device that boosts and heats a liquid fuel (a low-temperature liquid) and injects the liquid fuel to an inside of a combustion chamber in an internal combustion engine 90 at a high pressure to supply the liquid fuel. The internal combustion engine 90 is a power engine such as a reciprocating engine and a gas turbine that burns the fuel in a combustion chamber in a cylinder and is actuated by the heat energy. The use of a diesel engine that performs compression ignition on the fuel as the internal combustion engine 90 is especially preferable. The following embodiment describes the case using the diesel engine mounted to a ship as the internal combustion engine 90. However, the present invention is also applicable to a fuel supply device for a diesel engine other than the ship.

As illustrated in FIG. 1, the fuel supply device 10 includes a liquid fuel tank 11, a low-pressure fuel supply pipe 12, a linear actuator 30, a booster pump 50, a high-pressure fuel supply pipe 13, a heat exchanger 14, a high-temperature fuel supply pipe 15, a pressure regulating valve 16, and a pressure gauge 17. All these components of the fuel supply device 10 are mounted to the ship.

The liquid fuel tank 11 accumulates the fuel supplied to the internal combustion engine 90 in a form of a low-temperature liquid. For example, a liquid methane, a liquid ethane, and a liquid propane are applicable as the liquid fuel accumulated in the liquid fuel tank 11. The liquid fuel tank 11 is coupled to the low-pressure fuel supply pipe 12 to supply the liquid fuel to the booster pump 50 via the low-pressure fuel supply pipe 12.

The low-pressure fuel supply pipe 12 couples a lower end portion of the liquid fuel tank 11 and an upper end portion of the booster pump 50. A pressure of the liquid fuel in the low-pressure fuel supply pipe 12 is a pressure according to a temperature of the liquid fuel in the liquid fuel tank 11, a liquid surface height in the liquid fuel tank 11 with respect to the booster pump 50, and a similar condition. The liquid fuel tank 11 is disposed at a position higher than a position of the booster pump 50 such that a high Net Positive Suction Head (NPSH) is secured by this pressure and the liquid fuel is easily supplied to the booster pump 50.

As described later, there may be a case where the gas evaporated in the booster pump 50 is returned from the booster pump 50 to the low-pressure fuel supply pipe 12. The gas evaporated in the booster pump 50 may be returned to the liquid fuel tank 11 through the low-pressure fuel supply pipe 12. Separately from the low-pressure fuel supply pipe 12, a pipe 21 that returns the gas evaporated in the booster pump 50 to a gas phase space of the liquid fuel tank 11 may be disposed. Furthermore, a reliquefaction device 20 that re-liquefies the evaporated gas may be disposed to return the liquid fuel re-liquefied by the reliquefaction device 20 to the liquid fuel tank 11 through the pipe 21.

The booster pump 50 is disposed between the low-pressure fuel supply pipe 12 and the high-pressure fuel supply pipe 13. The booster pump 50 is a reciprocating pump driven by the linear actuator 30.

The booster pump 50 boosts the liquid fuel supplied from the low-pressure fuel supply pipe 12 and supplies the liquid fuel to the heat exchanger 14 via the high-pressure fuel supply pipe 13. The high-pressure fuel supply pipe 13 may include a pulsation damper (an accumulator) to absorb a pressure variation of the internal fuel.

The linear actuator 30 drives a piston for the booster pump 50. The use of the linear actuator 30 allows the piston for the booster pump 50 to be driven at a speed lower than the case of using a crankshaft. In a piston stroke, the linear actuator 30 can drivingly control the piston such that the piston moves at a constant velocity except for a start of flowing of the liquid in the booster pump, a start of liquid boost, and an end of the liquid boost. For example, a hydraulic cylinder unit and an electric cylinder unit can be used as the linear actuator 30. The following embodiment describes the case of using the hydraulic cylinder unit as the linear actuator 30; however, the linear actuator 30 is not limited to the hydraulic cylinder unit.

An inlet side of the heat exchanger 14 is coupled to the high-pressure fuel supply pipe 13 while an outlet side is coupled to the high-temperature fuel supply pipe 15. The heat exchanger 14 heats the liquid fuel after the boost supplied via the high-pressure fuel supply pipe 13. For example, a heat of combustion of a boil off gas generated in the liquid fuel tank 11 is applicable as a heat source to heat the liquid fuel. Alternatively, heat exchange with warm water heated by the heat of combustion of the boil off gas may heat the liquid fuel.

The high-temperature fuel supply pipe 15 has the pressure regulating valve 16. One end of the high-temperature fuel supply pipe 15 is coupled to the heat exchanger 14 while the other end is coupled to the combustion chamber of the internal combustion engine 90. The high-temperature fuel supply pipe 15 has the pressure gauge 17. The liquid fuel after heated by the heat exchanger 14 is regulated to a pressure in a predetermined range required by the internal combustion engine 90 by the pressure regulating valve 16, and then is supplied to the combustion chamber of the internal combustion engine 90 via the high-temperature fuel supply pipe 15.

The pressure in the predetermined range required by the internal combustion engine 90 differs depending on a type and performance of the internal combustion engine 90. When the internal combustion engine 90 is a two-stroke cycle, low-speed diesel engine for ship, the pressure in the predetermined range is, for example, 5 to 100 MPa and preferably 20 to 70 MPa; however, the present invention is not limited to this.

The liquid fuel tank 11, the low-pressure fuel supply pipe 12, the linear actuator 30, the booster pump 50, the high-pressure fuel supply pipe 13, the heat exchanger 14, the high-temperature fuel supply pipe 15, the pressure regulating valve 16, and the pressure gauge 17 are disposed in a danger zone. Meanwhile, a controller 21 and a control unit 80 are generally non-explosion-proof products and therefore need to be disposed in a non-danger zone isolated from the danger zone by an explosion-proof partition wall or disposed in a non-explosion-proof zone sufficiently providing a distance from the danger zone.

Figure 2:
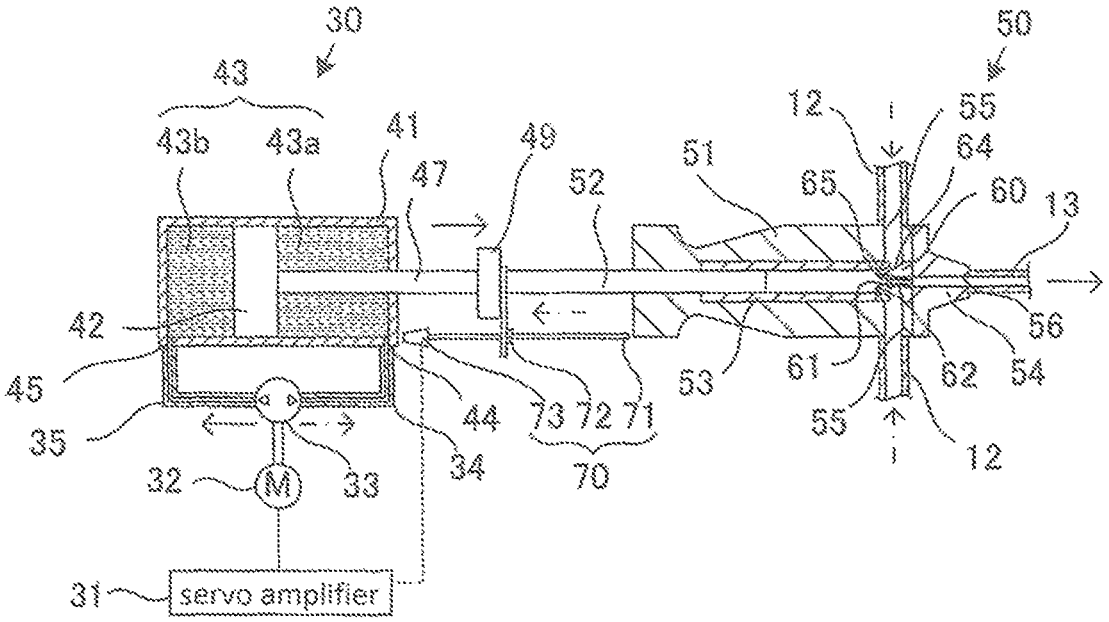
FIG. 2 is a cross-sectional view of a linear actuator 30 and a booster pump 50.

The following describes configurations of the linear actuator 30 and the booster pump 50 with reference to FIG. 2.

This embodiment includes the linear actuator 30 and the booster pump 50 in the identical axial direction. A right-left direction in FIG. 2 is the axial direction of the linear actuator 30 and the booster pump 50. The booster pump 50 is disposed to the right of the linear actuator 30 in FIG. 2.

As illustrated in FIG. 2, the linear actuator 30 includes a servo amplifier 31, an electric motor 32, a hydraulic pump 33, a first hydraulic pipe 34, a second hydraulic pipe 35, a hydraulic cylinder 41, a hydraulic piston 42, a piston rod 47, and a similar component.

The servo amplifier 31 drives the electric motor 32, and the electric motor 32 rotates the hydraulic pump 33. A servo motor is applicable as the electric motor 32. The use of the servo motor as the electric motor 32 ensures increasing a response speed compared with an inverter motor and ensures a minute control.

The hydraulic pump 33 is coupled to the first hydraulic pipe 34 and the second hydraulic pipe 35. The electric motor 32 drives the hydraulic pump 33. A direction of discharging a hydraulic oil from the hydraulic pump 33 switches according to normal and reverse rotation directions of the electric motor 32. For example, in the normal rotation of the electric motor 32, the hydraulic pump 33 suctions the hydraulic oil in the first hydraulic pipe 34 and discharges the suctioned hydraulic oil to the second hydraulic pipe 35. In the reverse rotation of the electric motor 32, the hydraulic pump 33 suctions the hydraulic oil in the second hydraulic pipe 35 and discharges the suctioned hydraulic oil to the first hydraulic pipe 34. Flow rates and pressures of the hydraulic oil in the first hydraulic pipe 34 and the second hydraulic pipe 35 are determined by the discharge amount from the hydraulic pump 33. The flow rate and the pressure of the hydraulic oil can be adjusted by the number of rotations of the electric motor 32.

Any hydraulic oil can be employed among a petroleum-based hydraulic oil, a synthetic hydraulic oil, a water-based hydraulic oil, or a similar hydraulic oil.

The hydraulic cylinder 41 has a tubular shape and has an axial direction in the right-left direction in FIG. 2. The hydraulic cylinder 41 has a hydraulic oil housing space 43 that houses the hydraulic oil. The hydraulic oil housing space 43 internally houses the hydraulic piston 42 to be movable in the axial direction.

The hydraulic piston 42 partitions the hydraulic oil housing space 43 into a first chamber 43*a*, which is on the right side with respect to the hydraulic piston 42 (the booster pump 50 side) and a second chamber 43*b*, which is the left side with respect to the hydraulic piston 42 (the side opposite to the booster pump 50). The hydraulic piston 42 is a single rod type and has the piston rod 47 projecting from a right-side end portion (a right end portion in FIG. 2) of the hydraulic cylinder 41 to the outside. The piston rod 47 axially moves together with the hydraulic piston 42.

The hydraulic cylinder 41 has a first through-hole 44 communicated with the first chamber 43*a* at a right-side end portion on the sidewall. The hydraulic cylinder 41 has a second through-hole 45 communicated with the second chamber 43*b* at a left-side end portion on the sidewall. An outer opening of the first through-hole 44 is coupled to the first hydraulic pipe 34. An outer opening of the second through-hole 45 is coupled to the second hydraulic pipe 35.

An outer end portion of the piston rod 47 (the right side in FIG. 2) is coupled to a left-side end portion of a boost piston 52 of the booster pump 50 with a coupling portion 49. The coupling portion 49 may have an axis core displacement adjustment function between the piston rod 47 and the boost piston 52.

The booster pump 50 includes a boost cylinder 51, the boost piston 52, a cylinder liner 53, a cover 54, a valve casing 60, and a similar component.

The boost cylinder 51 has a space to internally house the cylinder liner 53 and the valve casing 60. The boost cylinder 51 houses the boost piston 52 such that the boost piston 52 is axially movable inside the cylinder liner 53. The valve casing 60 is fixed to the inside of the boost cylinder 51 with the cover 54.

At a sidewall of the boost cylinder 51, one or a plurality of suction ports 55 are disposed at positions where the valve casing 60 is fixed to the inside of the boost cylinder 51. The suction port 55 is coupled to the low-pressure fuel supply pipe 12. At least one of the suction ports is preferably disposed at an upper end portion of the boost cylinder 51.

The cover 54 is fixed to an end portion of the boost cylinder 51 at a side opposite to a side into which the boost piston 52 is inserted. The cover 54 has a discharge port 56 axially penetrating the boost piston 52. The discharge port 56 is coupled to the high-pressure fuel supply pipe 13.

An outer end portion of the boost piston 52 (the left-side end portion in FIG. 2) is coupled to one end (the right-side end portion in FIG. 2) of the piston rod 47 with the coupling portion 49. The boost piston 52 axially (the right-left direction in FIG. 2) moves in conjunction with the piston rod 47.

The boost piston 52 has a position sensor 70. The position sensor 70 detects the axial position (the right-left direction in FIG. 2) of the boost piston 52 and outputs a position signal to the servo amplifier 31. Executing a time derivative on a displacement of the boost piston 52 using the position signal allows obtaining a velocity of the boost piston 52. That is, the position sensor can also be used as a velocity sensor. Furthermore, executing the time derivative on the velocity of the boost piston 52 allows obtaining an acceleration of the boost piston 52. That is, the position sensor 70 can also be used as an acceleration sensor.

As the position sensor 70, for example, a magnetostrictive position sensor and an ultrasonic wave sensor are applicable. The following describes the case using the magnetostrictive position sensor.

Specifically, the position sensor 70 includes a sensor probe 71 (a magnetostrictive line), a ring-shaped magnet 72, and a detector 73. The sensor probe 71 is disposed parallel to the boost piston 52. The ring-shaped magnet 72 into which the sensor probe 71 is inserted at the center is mounted to the boost piston 52 along the sensor probe 71 so as to axially move together with the boost piston 52. The detector 73 is disposed at one end of the sensor probe 71 to detect a distortion generated in the sensor probe 71. Applying a current pulse signal to the sensor probe 71 generates a magnetic field in a circumferential direction around the sensor probe 71. Since the magnetic field is applied in the axial direction of the sensor probe 71 at a position of the sensor probe 71 identical to the ring-shaped magnet 72, a synthesized magnetic field is generated in an oblique direction with respect to the axial direction. This generates a local torsional strain at the sensor probe 71. The detector 73 detects this torsional strain to detect the position of the ring-shaped magnet 72 and outputs the position signal indicative of the axial position of the boost piston 52 to the controller 21.

Instead of disposing the position sensor 70 to the boost piston 52, the position sensor 70 may be mounted to the piston rod 47.

The valve casing 60 is fixed between the cylinder liner 53 and the cover 54 inside the boost cylinder 51. The valve casing 60 includes a discharge flow passage 61, a discharge check valve 62, a suction flow passage 64, a suction check valve 65, and a similar component.

The discharge flow passage 61 is disposed so as to penetrate the valve casing 60 in the axial direction of the boost piston 52. An opening of the discharge flow passage 61 on the cover 54 side is disposed at a position opposed to the discharge port 56 of the cover 54. The discharge check valve 62 is disposed at the inside of the discharge flow passage 61 to prevent a fluid from flowing from the cover 54 to the cylinder liner 53 while to allow the flow of the fluid from the cylinder liner 53 to the cover 54.

The suction flow passage 64 is disposed so as to be communicated from an external wall of the valve casing 60 to a space inside the cylinder liner 53. An opening of the suction flow passage 64 on the external wall side of the valve casing 60 is disposed at a position opposed to the suction port 55 of the boost cylinder 51. The suction check valve 65 is disposed at the suction flow passage 64 to prevent the flow of the fluid from the cylinder liner 53 to the suction port 55 while to allow the flow of the fluid from the suction port 55 to the cylinder liner 53.

Figure 3:
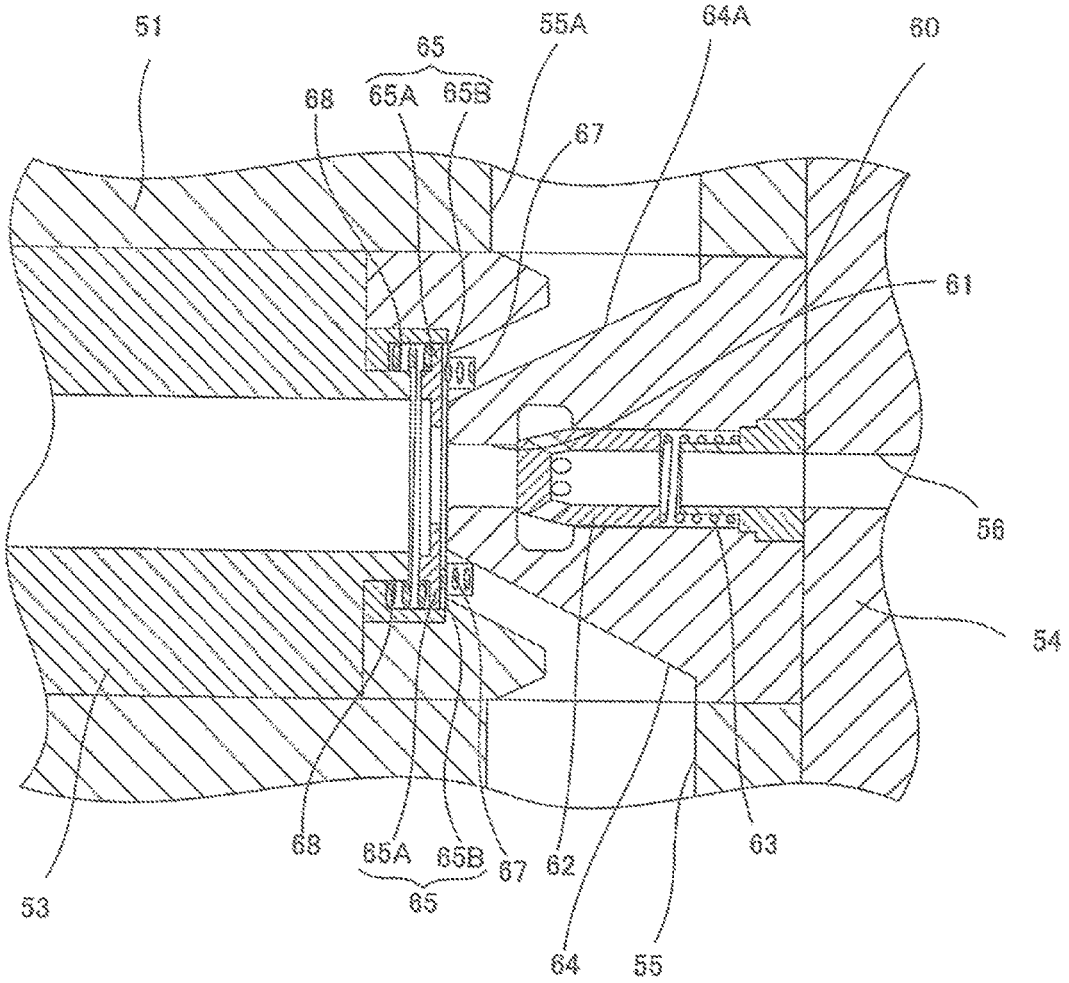
FIG. 3 is an enlarged view of a valve casing 60 in FIG. 2.

FIG. 3 is an enlarged view of the valve casing 60 in FIG. 2. As illustrated in FIG. 3, the valve casing 60 includes the suction check valve 65 that opens and closes the opening of the suction flow passage 64 communicated with the boost cylinder 51. When the suction flow passage 64 is covered, a part where a valve element 65A of the suction check valve 65 abuts on is a valve seat 65B.

The valve casing 60 further includes a first biasing member 67 and a second biasing member 68. The first biasing member 67 biases the valve element 65A of the suction check valve 65 in a direction away from the valve seat 65B. The second biasing member 68 biases the valve element 65A of the suction check valve 65 in a direction approaching the valve seat 65B. The first biasing member 67 and the second biasing member 68 are, for example, coil springs.

The biasing force to the valve element 65A by the first biasing member 67 and the biasing force to the valve element 65A by the second biasing member 68 are adjusted to be balanced at a position where the valve element 65A is away from the valve seat 65B.

In this embodiment, it is preferable that the suction check valve 65 is closed when a relative pressure at an internal space of the cylinder liner 53 establishing a pressure of the liquid fuel in the suction flow passage 64 before being suctioned into the internal space of the cylinder liner 53 as a criterion becomes higher than a predetermined pressure. Specifically, the biasing force to the valve element 65A by the first biasing member 67 and the biasing force to the valve element 65A by the second biasing member 68 are preferably adjusted so as to establish the following. A drag by the gas generated by evaporating the liquid fuel suctioned into the space inside the cylinder liner 53 does not close the valve element 65A. The valve element 65A closes when a force larger than the drag by the gas generated by evaporating the liquid fuel acts on the valve element 65A in a direction that the valve element 65A approaches the valve seat 65B. The "drag by the gas generated by evaporating the liquid fuel the liquid fuel" means a flow force caused by a pressure difference generated when the gas passes through a fine clearance between the valve element 65A and the valve seat 65B and attempts to flow backward to the suction flow passage 64.

This adjustment allows discharging the gas from the suction flow passage 64 to the low-pressure fuel supply pipe 12 when the gas generated by evaporating the liquid fuel is present in the internal space of the cylinder liner 53. Meanwhile, since the drag when the liquid fuel as the liquid attempts to flow backward to the suction flow passage 64 closes the valve element 65A, this ensures preventing the liquid fuel as the liquid from flowing backward to the suction flow passage 64.

As indicated by reference numeral 55A in FIG. 3, at least one of the suction ports 55 is preferably disposed communicated with an upper end portion of the internal space of the boost cylinder 51. As indicated by reference numeral 64A in FIG. 3, at least one of the suction flow passage 64 is preferably disposed at the upper side part of the valve casing 60 communicated with the suction port 55A, which is disposed at the upper end portion of the boost cylinder 51. The gas generated by evaporating the liquid fuel is likely to accumulate on the upper side part of the internal space of the cylinder liner 53. Therefore, disposing the suction port 55A communicated with the upper end portion of the internal space of the boost cylinder 51 promotes the discharge of the gas generated by evaporating the liquid fuel from the upper portion of the internal space of the cylinder liner 53 to the suction flow passage 64A and then from the suction port 55A to the low-pressure fuel supply pipe 12 outside the boost cylinder 51.

The gas generated by evaporating the liquid fuel discharged to the low-pressure fuel supply pipe 12 is reliquefied by the reliquefaction device 20 and is returned to the liquid fuel tank 11 as the liquid fuel through the pipe 21.

[Operations of Linear Actuator and Booster Pump]

The following describes the operations of the linear actuator 30 and the booster pump 50.

First, during the suction, the electric motor 32 drives the hydraulic pump 33, and as indicated by the dashed arrow in FIG. 2, the hydraulic oil inside the second chamber 43*b* is discharged from the second through-hole 45, passes through the second hydraulic pipe 35 and the first hydraulic pipe 34, and is supplied from the first through-hole 44 to the first chamber 43*a*. Then, the hydraulic piston 42 moves in the left direction in FIG. 2 inside the hydraulic oil housing space 43 such that a volume of the second chamber 43*b* decreases and a volume of the first chamber 43*a* increases.

When the hydraulic piston 42 moves in the left direction in FIG. 2, in the booster pump 50, the boost piston 52 coupled to the right-side end portion of the piston rod 47 with the coupling portion 49 moves in the left direction in FIG. 2 inside the cylinder liner 53. Then, the liquid fuel is supplied from the suction port 55 through the suction flow passage 64 to the space inside the cylinder liner 53 and to the right with respect to the boost piston 52. At this time, the suction check valve 65 opens the suction flow passage 64, and the discharge check valve 62 closes the discharge flow passage 61.

Next, during the discharge, the servo amplifier 31 switches the rotation direction of the electric motor 32 to drive the hydraulic pump 33 in the opposite direction. As indicated by the solid line arrow in FIG. 2, the hydraulic oil inside the first chamber 43*a* is discharged from the first through-hole 44, passes through the first hydraulic pipe 34 and the second hydraulic pipe 35, and is supplied from the second through-hole 45 to the second chamber 43*b*. Then, the hydraulic piston 42 moves in the right direction in FIG. 2 inside the hydraulic oil housing space 43 such that the volume of the second chamber 43*b* increases and the volume of the first chamber 43*a* decreases.

When the hydraulic piston 42 starts moving in the right direction in FIG. 2, the boost piston 52 of the booster pump 50 coupled to the right-side end portion of the piston rod 47 with the coupling portion 49 starts moving in the right direction in FIG. 2 inside the cylinder liner 53. At this time, a pressure difference of the pressure inside the cylinder liner 53 to the pressure of the liquid fuel in the suction flow passage 64 is yet small and is equal to or less than the pressure to close the valve element 65A; therefore, the suction check valve 65 remains open. Meanwhile, the pressure difference of the pressure of the liquid fuel in the high-pressure fuel supply pipe 13 to the pressure of the liquid fuel in the cylinder liner 53 is yet sufficiently large; therefore, the discharge check valve 62 closes the discharge flow passage 61.

The drag that the gas generated by evaporating the liquid fuel attempts to flow backward to the suction flow passage 64 does not close the valve element 65A. Therefore, while the hydraulic piston 42 starts moving in the right direction in FIG. 2, the gas generated by evaporating the liquid fuel is present in the internal space of the cylinder liner 53, the gas passes through the clearance between the valve element 65A and the valve seat 65B and the suction flow passage 64 and is discharged from the suction port 55 to the low-pressure fuel supply pipe 12 outside the boost piston 52.

When all gas is discharged from the internal space of the cylinder liner 53, the drag by the liquid fuel closes the suction check valve 65. The "drag by the liquid fuel" means a flow force caused by the pressure difference generated when the liquid fuel passes through the fine clearance between the valve element 65A and the valve seat 65B and attempts to flow backward to the suction flow passage 64. Then, by the hydraulic piston 42 further attempting to move in the right direction in FIG. 2, the pressure of the liquid fuel in the internal space of the cylinder liner 53 increases. When the pressure of the liquid fuel in the cylinder liner 53 becomes sufficiently larger relative to the pressure of the liquid fuel in the high-pressure fuel supply pipe 13, the discharge check valve 62 opens and the boosted liquid fuel is discharged from the discharge flow passage 61 to the discharge port 56.

Thus, discharging the gas generated by evaporating the liquid fuel from the suction flow passage to the low-pressure fuel supply pipe 12 outside the boost cylinder ensures boosting only the liquid fuel as the liquid without the compression of the gas. Especially, the booster pump 50 has an ordinary temperature at the start of the booster pump 50. Accordingly, when the liquid fuel is supplied to the internal space of the cylinder liner 53, a large amount of gas generated by evaporating the liquid fuel is generated in the internal space of the cylinder liner 53 until the booster pump 50 is cooled down to the temperature of the liquid fuel. This embodiment is configured to discharge this gas to the low-pressure fuel supply pipe 12 outside the booster pump 50, thereby ensuring enhancing the efficiency of discharge.

Since the gas does not remain in the internal space of the cylinder liner 53, the pressure at the internal space of the cylinder liner 53 is likely to decrease. Furthermore, since the biasing force to the valve element 65A by the first biasing member 67 and the biasing force to the valve element 65A by the second biasing member 68 are adjusted so as to be balanced at the position that the valve element 65A is away from the valve seat 65B, the liquid fuel can be promptly suctioned into the internal space of the cylinder liner 53, thereby ensuring enhancing efficiency of suction.

While the embodiment describes the case where the boost cylinder 51 of the booster pump 50 is horizontally disposed, the present invention is not limited to this. The boost cylinder 51 may be vertically or obliquely disposed. In this case, considering a gravitation acting on the suction check valve 65, it is only necessary to adjust the biasing force to the valve element 65A by the first biasing member 67 and the biasing force to the valve element 65A by the second biasing member 68 to be balanced at the position where the valve element 65A is away from the valve seat 65B. In this case as well, at least one suction port 55A and the suction flow passage 64A are preferably disposed communicated with the upper end portion of the internal space of the boost cylinder 51. In view of this, the booster pump 50 is preferably disposed such that the liquid fuel is discharged when the boost piston 52 moves inside the boost cylinder 51 upward and the liquid fuel is suctioned when the boost piston 52 moves downward.

REFERENCE SIGNS LIST

10 fuel supply device
11 liquid fuel tank
12 low-pressure fuel supply pipe
13 high-pressure fuel supply pipe
14 heat exchanger
15 high-temperature fuel supply pipe
16 pressure regulating valve
17 pressure gauge
20 reliquefaction device
21 pipe
30 linear actuator
31 servo amplifier
32 electric motor
33 hydraulic pump
34 first hydraulic pipe
35 second hydraulic pipe
41 hydraulic cylinder
42 hydraulic piston
43 hydraulic oil housing space
43*a* first chamber
43*b* second chamber
47 piston rod
49 coupling portion
50 booster pump
51 boost cylinder
52 boost piston
53 cylinder liner
54 cover
55, 55A suction port
56 discharge port
60 valve casing

61 discharge flow passage
62 discharge check valve
64, 64A suction flow passage
65 suction check valve
65A valve element
65B valve seat
67 first biasing member
68 second biasing member
70 position sensor
71 sensor probe
72 ring-shaped magnet
73 detector
80 control unit
90 internal combustion engine

What is claimed is:

1. A reciprocating booster pump comprising:

a cylinder that has a suction port and a discharge port, the suction port suctioning a low-pressure, low-temperature liquid to an inside, the discharge port being for boosting and discharging the low-temperature liquid to an outside;

a piston that reciprocates in an internal space of the cylinder, the piston having a position sensor to control a traverse speed of the piston:

a suction check valve that opens and closes a suction flow passage between the internal space and the suction port;

a discharge check valve that opens and closes a discharge flow passage between the internal space and the discharge port;

a first coil spring that is disposed on the suction port side with respect to the suction check valve and biases a valve element of the suction check valve in a direction away from a valve seat; and a second coil spring that is disposed on the internal space side with respect to the suction check valve and biases the valve element in a direction of approaching the valve seat, wherein the suction port is disposed to be communicated with an upper end portion of the internal space of the cylinder, and the suction check valve is configured, along with movement of the piston, to not close when a gas within the cylinder flows backward to the suction flow passage, and to close by drag when the liquid within the cylinder flows back to the suction flow passage.

2. The booster pump according to claim 1, wherein a biasing force to the valve element by the first coil spring and a biasing force to the valve element by the second coil spring are adjusted to be balanced at a position where the valve element is away from the valve seat.

3. The booster pump according to claim 1, wherein the suction check valve is configured such that if a force larger than a drag by a gas generated by evaporating the low-temperature liquid acts on the valve element of the suction check valve in a direction that the valve element approaches the valve seat of the suction check valve, the suction check valve closes.

4. The booster pump according to claim 2, wherein the biasing force to the valve element by the first coil spring and the biasing force to the valve element by the second coil spring are configured such that if a force larger than a drag by a gas generated by evaporating the low-temperature liquid acts on the valve element of the suction check valve in the direction that the valve element approaches the valve seat of the suction check valve, the suction check valve is adjusted to close.

5. A method for boosting a low-temperature liquid that boosts a low-pressure, low-temperature liquid to produce a high pressure liquid, the method comprising:

disposing a cylinder, a piston, a suction check valve, a first coil spring, and a second coil spring in a booster pump, the booster pump boosting the low-temperature liquid from a low-pressure liquid supply pipe that supplies the low-pressure, low-temperature liquid, the piston being disposed to reciprocate in an internal space of the cylinder, the suction check valve being configured to suction the low-temperature liquid into the internal space of a cylinder of the booster pump, the suction check valve preventing the low-temperature liquid from flowing backward from the booster pump to the low-pressure liquid supply pipe, the first coil spring being disposed on the suction port side with respect to the suction check valve and biasing a valve element of the suction check valve in a direction away from a valve seat, the second coil spring being disposed on the internal space side with respect to the suction check valve and biasing the valve element in a direction of approaching the valve seat;

adjusting the suction check valve such that, along with movement of the piston, the suction check valve does not close when a gas within the cylinder flows backward to the suction flow passage, and closes by drag when the liquid within the cylinder flows back to the suction flow passage;

flowing the gas generated by evaporating the low-temperature liquid in the booster pump backward to the low-pressure liquid supply pipe through the suction check valve; and controlling a traverse speed of the piston via a position sensor.

6. The booster pump according to claim 2, wherein the suction check valve is configured such that if a force larger than a drag by a gas generated by evaporating the low-temperature liquid acts on the valve element of the suction check valve in a direction that the valve element approaches the valve seat of the suction check valve, the suction check valve closes.

7. The booster pump according to claim 1, wherein the piston is controlled via the position sensor to reciprocate in an internal space of the cylinder at a constant velocity.

8. The booster pump according to claim 1, further comprising:

a linear actuator operatively connected to control the traverse speed of the piston with the position sensor.

9. The method according to claim 5, wherein the step of controlling the traverse speed of the piston via a position sensor includes controlling the piston to reciprocate at a constant velocity.

10. The method according to claim 9, wherein the step of controlling the traverse speed of the piston via a linear actuator with the position sensor.

* * * * *